United States Patent [19]

Kedzierski

[11] Patent Number: 5,031,286

[45] Date of Patent: Jul. 16, 1991

[54] SLIDER FOR A SLIDE FASTENER

[75] Inventor: Stanley G. Kedzierski, Saegertown, Pa.

[73] Assignee: Talon, Inc., Meadville, Pa.

[21] Appl. No.: 574,047

[22] Filed: Aug. 29, 1990

[51] Int. Cl.[5] ..... A44B 19/30

[52] U.S. Cl. ..... 24/421; 24/425; 24/429

[58] Field of Search ..... 24/421, 422, 424, 425, 24/429, 419

[56] References Cited

U.S. PATENT DOCUMENTS

| | | | |
|---|---|---|---|
| 2,978,772 | 4/1961 | Brown | 24/425 |
| 3,133,328 | 5/1964 | Huelster | 24/421 |
| 3,262,172 | 7/1966 | Scheuerman | 24/421 |
| 4,074,399 | 2/1978 | Kedzierski | 24/425 |
| 4,081,883 | 4/1978 | Ishii et al. | 24/421 |
| 4,422,220 | 12/1983 | Oda | 24/421 |

*Primary Examiner*—Victor N. Sakran
*Attorney, Agent, or Firm*—Anthony A. O'Brien

[57] ABSTRACT

A locking slider assembly is shown for use with a slide fastener having separable fastener elements having a slider body, upper and lower spaced parallel wings joined at their front ends on the body. A pair of upstanding body tabs are upstruck from the upper wing which also has a front and rear opening therethrough. A leaf spring has a down turned nose terminating in a downwardly bent spring prong for engaging the fastener elements of the slide fastener. A spring means extends off the leaf spring rearwardly of the down turned nose and passes into the forward openings of the upper wing and is positioned to be engaged by the upstanding body tabs on the upper wing. A spring biasing extension is in engagement with the upper wing to impart spring loading to the spring prong to assure engagement with the fastener elements.

3 Claims, 1 Drawing Sheet

SLIDER FOR A SLIDE FASTENER

TECHNICAL FIELD

The present invention relates to sliders for slide fasteners and, more particularly, to such sliders that are automatically locked in place when the slider's pull tab is not being operated or pulled.

BACKGROUND OF THE PRIOR ART

The prior art is exemplified by U.S. Pat. Nos. 4,074,399; 4,081,883; and 4,422,220. The present invention is an improvement on my prior U.S. Pat. No. 4,074,399 and distinguishes over the above patents which do not have sliders with the same low-profile and with the same locking spring that is pre-loaded on a slider body in the assembled position.

SUMMARY OF THE INVENTION

The invention is directed to a locking slide for a slide fastener having separable fastener elements in which the slide body has upper and lower spaced parallel wings joined at their front ends and a pair of upstanding body tabs are upstruck from the upper wing. The upper wing has a front and rear opening therethrough. A leaf spring has a downturned forward nose which terminates in a downwardly bent spring prong for engaging the fastener elements of the slide fastener and down turned spring legs rearwardly of the down turned nose which pass through the rear opening in the upper wing and are positioned to be engaged by the upstanding body tabs on the upper wing. The pull operator eccentric release bar seats in the saddle between upstanding bosses adjacent the forward edge of the front opening through the wing and a slider body lug passing through the window in the left spring. A tail extends off the leaf spring and engaged the top of the upper wing and the eccentric release bar of the pull operator to impart spring loading to the spring so that upon rotation of the pull tab the eccentric release bar in the saddle will cause disengagement of the spring prong projection from the fastener element to make an adjustment of the slider and its locking engagement with the fastener elements to control the amount of opening of the slide fastener.

An object of the present invention is to provide a fastener having a spring prong constructed so that a desired ratcheting effect takes place under extreme locking loads eliminating the possibility of irreversible damage to the fastener elements allowing the spring prong to ratchet over each successive element not causing damage but effecting a desired lock level.

A further object of the present invention is to provide a slide fastener slider providing an extremely resilient spring member guarded against all destructive forces encountered in its end use and which has an overall assembly height which results in the lowest possible profile.

DETAILED DESCRIPTION

Figure 2:
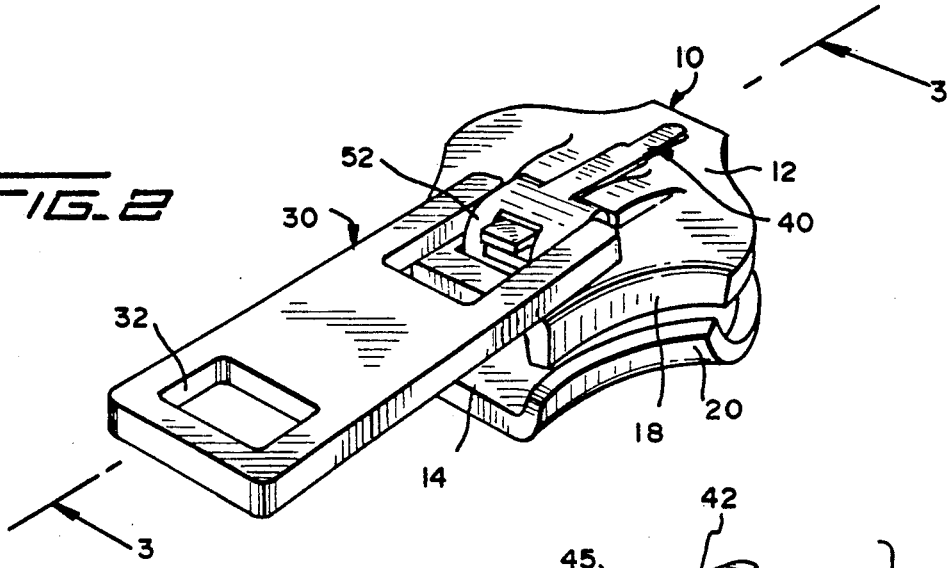
FIG. 2 is a perspective view of FIG. 1 showing the elements in assembled condition.
Figure 2:
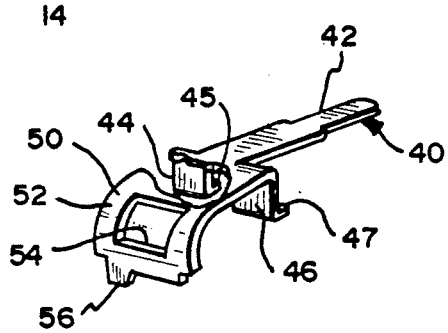

The present invention is embodied in a slider device for a slide fastener. The slider (see FIG. 2) includes a simple construction of only three components, namely, a slider body, a pull tab and a locking spring. The three components can be automatically assembled substantially without component deformation. This embodiment provides an extremely resilient spring member guarded against destructive forces encountered in its use in a slide fastener. The overall height of this assembly results in the lowest possible profile.

Figure 1:
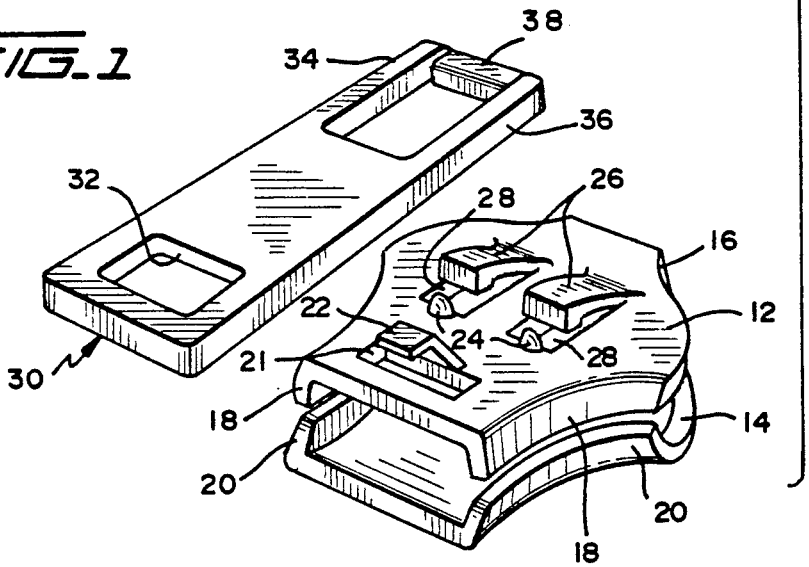
FIG. 1 is an exploded perspective view of a zipper slider embodying the present invention.

The slider body, indicated generally at 10, may be manufactured by a coined or forged technique or a flat form technique using steel, nugild or nickle as a material. The slider body 10 is shown in FIG. 1 as including upper and lower wings 12 and 14 which are spaced in parallel relation to each other and which are connected at their front ends by means of a post 16 as conventionally shown in U.S. Pat. No. 4,074,399, which is incorporated herein by reference. The upper and lower wings 12 and 14 are similarly shaped and have similar flanges 18 and 20, respectively, along their lateral side edges extending toward each other as shown in FIG. 1. The top surface of upper wing 12 is formed with a generally rectangular opening 21 adjacent its rear portion and with a portion sloping upwardly to terminate in a horizontal projection spaced above the upper wing 12 and over the opening 21; all of which defines a retaining lug 22. Formed on the intermediate portion of the top surface of upper wing 12 are a pair of spaced upstanding guide bosses 24 which are positioned on opposite sides of the longitudinal center line of slider 10. Spaced from the guide bosses 24 are a pair of spaced tabs 26 with a rectangular cut-outs 28 separating each boss 24 from each tab 26.

A pull operator, indicated generally at 30, is a flat metal slab and has a pull recess 32 formed at its rear portion and a pair of forwardly extending arms 34 and 36 terminating at its front portion where they are joined by an eccentric release bar 38. The rectangular bar 38 is integral with the arms 34 and 36 and is slightly depressed below the to surfaces of the arms 34 and 36. The pull operator may be manufactured by a blanking or casting technique.

A locking spring, indicated generally at 40, may be manufactured by a blanking and forming technique using stainless steel as a material. The locking spring 40 has an elongated forward extension 42 being substantially flat in construction. A pair of retention legs 44 and 46, one on each side of extension 42 and generally positioned at an intermediate portion of the spring 40. The L-shpaped legs 44 and 46 extend perpendicular from the extension 42 and terminate in bent ends 45 and 47, respectively. A rearward extension 50 of the spring 40 has a downwardly bent prong 52 with a rectangular aperture 54 therein. The prong 52 terminates in a tip 56 which is further bent toward the front of the spring 40 at an appropriate angle so that a desired ratcheting effect takes place under extreme locking loads. The ratcheting effect eliminates the possibiliy of irreversible damage to the interlocking elements of the slide fastener by allowing prong 52 to rachet over each successive element not causing damage but effecting a desired lock level.

Figure 3:
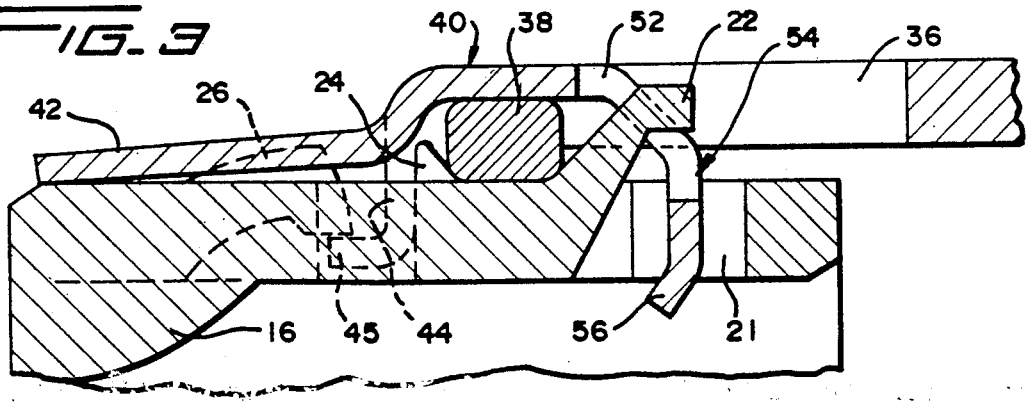
FIG. 3 is a partial cross sectional view taken along line 3-3 of FIG. 2, but with the parts reversed from left to right.

In its assembled locking position as shown in FIG. 3 it will be noted that the parts of slider body 10 and locking spring 40 do not extend above the plane defined by the top surface of the pull operator 30. This arrangement results in a very low profile for the slider. A low profile reduces the bulk of the assembly as is important for hidden type slide fasteners; in addition, the low profile facilitates ironing or pressing of a garment.

The slider devise is easily assembled and does not require a skilled worker because of its simplicity and of its use of only three parts. To assemble the pull operator 30 is disposed on the top surface of upper wing 12 with the cross bar 36 disposed between the sloping part of retaining lug 22 and the pair of bosses 24. The locking spring 40 then has its central portion engaging the cross bar 38 with prong 52 extending through the opening 21, with aperture 54 receiving the retaining lug 22, and with the legs 44 and 46 extending through respective cut-outs 28. As is shown in FIG. 3, the bent ends 45 and 47 of the legs are disposed under their respective tabs, 26, 26. Such tabs are then depressed by pushing forces on the top thereof to anchor the tabs 26, 26 into firm engagement with the bent ends 45 and 47. The bent ends 45 and 47 are thus anchored under the pull operator and its cross bar 38 whereby the assembly is rendered extremely strong guarding against any damage to the spring 40 as a result of an extreme pull operator forces.

The construction of the slider device includes a slider body which builds the required resiliency into the spring. The assembled locking position of the slider is illustrated in FIGS. 1 and 3 wherein the locking spring 40 is loaded in the assembled position against the slider body 10 with the spring leg ends 45 and 47 being secured by bending the two tabs 26, 26 down against the ends 45 and 47. In addition, the spring's forward extension 42 is pre-loaded against the top surface of the upper wing 12, which further enhances the loading of the spring 40 in its assembled position.

The slope of the retaining lug 22 and the semi-nose cone shape of the bosses 24 define a saddle which stabilizes the pull operator 30 thereby minimizing the swing effect of the pull operator from side to side. Such a feature is important to the garmet industry inasmuch as it decreases the incidence of needle damage during sewing machine installation of the slide fastener assembly into a garment.

Inasmuch as the present invention is subject to many modifications, variations, and changes in detail, it is intended that all matter contained in the foregoing specification or shown in the accompanying drawing, shall be interpreted as illustrative and not in a limiting sense.

I claim:

1. A locking slider assembly for use with a slide fastener having separable fastener elements comprising a slider body having upper and lower spaced parallel wings joined at their front ends on said body, a pair of upstanding body tabs up struck from the upper wing, said upper wing having a front and rear opening therethrough, a leaf spring having a down turned rearward nose terminating in a downwardly bent spring prong for engaging the fastener elements of said slide fastener, said down turned nose having a window therethrough and passing through the rear opening of said upper wing, spring means extending off said leaf spring forwardly of said down turned nose and passing into the front opening of said upper wing and being positioned to be engaged by said upstanding body tabs on said upper wing, a pair of upstanding bosses adjacent the rearward edge of the front opening beneath said upstanding body tabs, a slider body, lug extending up from said upper wing and passing through the window in said leaf spring, said slider body lug and bosses defining therebetween a saddle, a pull operator having an eccentric release bar at one end seatable in said saddle, said spring prong passing through the rear opening through said upper wing, spring biasing means in engagement with said upper wing to impart spring loading to said spring prong to assure engagement with the fastener elements of a slide fastener and upon rotating said eccentric release bar causing disengagement of said spring prong from engagement with the fastener elements of a slide fastener.

2. A locking slider assembly as claimed in claim 1 wherein said spring biasing means in engagement with said upper wing is a forward extension of said leaf spring positioned to bear against the top of said upper wing between said upstanding body tabs on said upper wing and biasing said down turned nose into locking engagement with the fastener elements of a slide fastener.

3. A locking slider assembly as claimed in claim 1 wherein said leaf spring has a down turned nose at one end having a window therethrough and a spring biasing extension at its opposite end positioned to engage the top of said upper wing, and a pair of spring biased legs positioned to be engaged by said upstanding body tabs and passing through the forward openings in said upper wing to impart a spring bias to the down turned nose passing through the forward opening of said upper wing.

* * * * *